US009266317B1

(12) United States Patent
Crawford et al.

(10) Patent No.: US 9,266,317 B1
(45) Date of Patent: Feb. 23, 2016

(54) REPLACEABLE HOT STAMP TRANSFER ROLLER REMOVABLY AFFIXED TO A CENTRAL CORE FOR IMAGE TRANSFER FROM AN IMAGE SOURCE TO A SURFACE OF AN OBJECT

(71) Applicants: Douglas E. Crawford, Burbank, CA (US); Mark Bowland, Thousand Oaks, CA (US)

(72) Inventors: Douglas E. Crawford, Burbank, CA (US); Mark Bowland, Thousand Oaks, CA (US)

( * ) Notice: Subject to any disclaimer, the term of this patent is extended or adjusted under 35 U.S.C. 154(b) by 0 days.

(21) Appl. No.: 14/842,090

(22) Filed: Sep. 1, 2015

(51) Int. Cl.

| | |
|---|---|
| ***B41F 19/02*** | (2006.01) |
| ***B44B 5/00*** | (2006.01) |
| ***B41F 16/00*** | (2006.01) |
| ***B41F 19/00*** | (2006.01) |
| ***B41F 19/06*** | (2006.01) |

(52) U.S. Cl.
CPC ..... *B41F 16/0026* (2013.01); *B41F 19/001* (2013.01); *B41F 19/062* (2013.01); *B44B 5/0071* (2013.01)

(58) Field of Classification Search
CPC .. B41F 16/0026; B41F 19/001; B41F 19/062; B44B 5/0071; B44B 5/028; D21G 1/0226
USPC ..... 101/5, 9, 23, 25; 492/2, 49
See application file for complete search history.

(56) References Cited

U.S. PATENT DOCUMENTS

| | | | | |
|---|---|---|---|---|
| 2,749,133 | A * | 6/1956 | Rich | B23B 31/1175 242/571.8 |
| 4,149,682 | A * | 4/1979 | Gustafson | B66C 1/54 242/571.3 |
| 5,786,051 | A | 7/1998 | Niggemeier et al. | |
| 5,860,360 | A | 1/1999 | Lane, III et al. | |
| 5,983,799 | A | 11/1999 | Lane, III et al. | |
| 8,075,465 | B2 | 12/2011 | Verfaellie et al. | |
| 8,250,977 | B2 | 8/2012 | Zlatin et al. | |
| 8,517,902 | B2 * | 8/2013 | Kim | H05B 6/6411 492/15 |
| 2003/0131743 | A1 | 7/2003 | Sauer et al. | |
| 2013/0228085 | A1 | 9/2013 | Bhullar et al. | |

* cited by examiner

*Primary Examiner* — Blake A Tankersley
*Assistant Examiner* — Marissa Ferguson Samreth
(74) *Attorney, Agent, or Firm* — Thomas I. Rozsa

(57) ABSTRACT

An apparatus wherein a hot stamp transfer roller can be quickly removed from the metal core after the hot stamp transfer roller is used up and immediately replaced with another hot stamp transfer roller so that the process can continue without having to return the central hub and the remaining portion of the hot stamp transfer roller to a facility where the hot stamp transfer roller is ground away from the central hub.

12 Claims, 8 Drawing Sheets

REPLACEABLE HOT STAMP TRANSFER ROLLER REMOVABLY AFFIXED TO A CENTRAL CORE FOR IMAGE TRANSFER FROM AN IMAGE SOURCE TO A SURFACE OF AN OBJECT

BACKGROUND OF THE INVENTION

1. Field of the Invention

The present invention relates to the field of transfer of hot stamped foil to the surface of an object.

2. Description of the Prior Art

Prior art for printing rollers was observed in previous issued patents and published patent applications. The previous art, however, does not solve the problem that currently exists in the hot foil stamping industry.

The following seven patents and published patent applications are the closest prior art known to the inventor.

1. U.S. Pat. No. 5,786,051 issued to Georg Niggemeier et al. on Jul. 28, 1998 for "Ink Transfer Roller with Interchangeable Cover" (hereafter the Niggemeier Patent");

2. U.S. Pat. No. 5,860,360 issued to William James Lane, III et al. on Jan. 19, 1999 for "Replaceable Printing Sleeve" (hereafter the "'360 Lane Patent");

3. U.S. Pat. No. 5,983,799 issued to William James Lane, III et al. on Nov. 16, 1999 for "Replaceable Sleeve" (hereafter the "'799 Lane Patent");

4. United States Published Patent Application No. 2003/0131743 issued to Alexander Sauer et al. on Jul. 17, 2013 for "Roller with Detachable Roller Cover" (hereafter the "Sauer Published Patent Application");

5. U.S. Pat. No. 8,075,465 issued to Paul Verfaellie et al. on Dec. 13, 2011 for "Roller Assembly with an Eccentric Expandable Cover Retaining Ring and a Method of Manufacturing the Roller Assembly" (hereafter the "Verfaellie Patent");

6. U.S. Pat. No. 8,250,977 issued to Lev Zlatin et al. on Aug. 28, 2012 for "Printing Press with Replaceable Sleeve Shell Segments For A Cylinder" (hereafter the "Zlatin Patent");

7. United States Published Patent Application No. 2013/0228085 to Raghbir Bhullar et al. on Sep. 5, 2013 for "Process for Refurbishing Cylinder Rolls and Bases for Printing Machines" (hereafter the "Bhullar Published Patent Application").

The Niggemeier Patent discloses an ink transfer roller with interchangeable cover. Specifically, the patent discloses:

> "An ink transfer roller for a support roller or support bar, in particular of metal, with a stretchable, interchangeable fiber-reinforced laminated plastic material cover (K) covered with a metal-ceramic layer (MK), which is provided with small ink transfer cups (FN), wherein the laminated plastic material cover (K) consists of a stretchable inner cover (UB) and an outer cover (OB), between which a foamed material compressible layer (SS) is enclosed."

This patent discloses the concept of having an exchangeable roller but it works differently than your invention in that the exchangeable roller essentially is an elastic type band which can be stretched over the center hub.

The '360 Lane Patent discloses a replaceable printing sleeve. In particular, the patent discloses:

> "A replaceable sleeve having a working surface is provided which is adapted to be mounted on a carrier. The sleeve includes an inner polymeric layer, a reinforcing layer overlying the inner layer, an intermediate polymeric layer overlying the reinforcing layer, and an outer polymeric layer. The sleeve may include a cushion layer between the intermediate layer and the outer layer. The layers comprising the sleeve are formed around a support and then cured simultaneously in a single step. The resulting sleeve may be used in printing operations or in other applications such as coating, embossing, laminating, calendering and the like."

The '799 Lane Patent discloses a replaceable sleeve having a working surface is provided which is adapted to be mounted on a carrier.

The Sauer Published Patent Application discloses:

> "Printing rollers, in particular ink rollers, dampening rollers or varnishing rollers for web-fed offset printing machines and sheet-fed offset printing machines, with a rigid roller core and a roller cover with an outside layer from elastomeric or elastic plastic material are constructed that way that the roller cover is connected with the roller core detachable. In this way for inking units, dampening units and varnishing units of printing machines rollers are made available, whose roller cover is exchangeable and can be used in a one-way method."

The Verfaellie Patent discloses:

> "A roller assembly for a production machine having an inner wheel base capable of attachment to the driving axle of a production machine and an expandable outer ring which is cooperatively connectable to the inner wheel base is disclosed. The circumference of the expandable outer ring is adjustable. An outer roller cover mounts circumferentially around the adjustable expandable outer ring."

The Zlatin Patent discloses a printing press with replaceable sleeve shell segments for a cylinder. The major concept of this invention is that you can vary the diameter of the printing wheel but it is implied within the concept that the printing wheel can be removed and replaced.

The Bhullar Published Patent Application discloses a process for refurbishing cylinder rolls and bases for printing machines.

None of the prior art patents address the problems that currently exist in the Hot Stamping industry.

SUMMARY OF THE INVENTION

The present invention is an improvement over prior art non-removable and non-replaceable hot stamp transfer rollers permanently affixed to a central core. In the prior art, when the hot stamp roller needs to be replaced, the prior art requires the entire remaining portion of the hot stamp roller and central hub to be taken to a specialized facility where the hot stamp roller is physically removed through a grinding process or other expensive process in order to physically remove the hot stamp roller so a new hot stamp roller can be physically affixed to the central core. The prior art does not have a screw-in threaded insert and instead, is one unitary piece having an interior metal section which is chemically bonded to a silicone hot stamp transfer roller. The hot stamp transfer roller assembly weighs about seven pounds. The prior art has the silicone hot stamp transfer roller affixed to the aluminum metal center roller so that when the silicone is used up during its runs, it is necessary to return the entire roller to have the silicone portion ground away by the manufacturer and replaced with a new silicone roller. This is both expensive and time consuming in that the entire roller assembly, which by way of example if it were a one-inch hot stamp transfer roller would weigh seven pounds which means that after it is used up, it is necessary to ship it back to the manufacturer to have the silicone hot stamp transfer roller ground off the central hub and the entire assembly refinished and then replaced with a substitute hot stamp transfer roller.

The present invention is an improvement over the prior art. The center aluminum section is the part that goes on the spindle for rotating the hot stamp transfer roller for which images are transferred from an image source to an object. The hot stamp transfer roller which is preferably made of silicone is removably affixed to the central core which is preferably made of aluminum by having tongue and groove interlocking sections and then the two sections can be affixed to each other through a cover plate that is screwed onto the central core section with affixation members such as threaded bolts.

The present invention is a significant improvement in hot stamp transfer rollers such as transferring of images from an image source to an object. In the prior art, the core, usually made of metal, was surrounded by and permanently retained a hot stamp transfer roller which preferably is made of silicone but can be made of other elastomeric or other materials. In the prior, the hot stamp transfer roller was molded or otherwise affixed to the metal core. When the hot stamp transfer roller was used up or needed to be replaced for any other reason, it was necessary to return the hot stamp transfer roller assembly to the manufacturer to have the used hot stamp roller ground off or otherwise removed from the central core and replaced with a new hot stamp roller permanently affixed to the central core. This is an expensive and time consuming process.

The present invention is a very significant improvement in the use of the hot stamp transfer rollers. The present invention is a hot stamp transfer roller which is removably affixed to the metal core and retained thereto by engaging tongue and groove slots around the inner circumference of the hot stamp transfer roller and corresponding tongue and groove slots around the exterior circumference of the metal core so that a closing cap can retain the hot stamp transfer roller around the metal core.

It is therefore a further object of the present invention to provide an apparatus wherein the hot stamp transfer roller can be quickly removed from the metal core after the hot stamp transfer roller is used up and immediately replaced with another hot stamp transfer roller so that the process can continue without having to return the central hub and the remaining portion of the hot stamp transfer roller to a facility where the hot stamp transfer roller is ground away from the central hub and then replaced with a new hot stamp transfer roller which is permanently bonded to the central hub.

It is a further object of the present invention to provide the concept of a hot stamp transfer roller which is removably affixed around the metal core by any appropriate mating methods including tongue and groove or mating slots. Further, it is within the spirit and scope of the present invention for the interior circumference of the hot stamp transfer roller to have other methods by which it can be interlocked to the metal core.

While the above has described the central core as being made of metal, preferably aluminum, it is also within the spirit and scope of the present invention for the central core to be made of other materials such as molded plastic, molded polyvinyl, injection molded glass filled nylon or other non-metallic materials which can absorb the heat and pressure that is required in order to perform the transfer process as described above. Typically, the transfer process is performed at high temperature such as 275 degrees to 350 degrees Fahrenheit and the pressure created by a pneumatic cylinder in the range of a quarter to a half a ton of pressure. Further, in operation, there is a source of heat that transfers heat in the range of 250 degrees Fahrenheit to 350 degrees Fahrenheit to the heat transfer roller in order to enable the transfer to take place. The central core is typically not heated because it is not a requirement for it to be heated for the transfer process to take place. Its requirement is to be able to support the heat transfer roller and operate at the speed and pressures and temperatures that are required to perform the heat transfer.

It is therefore an object of the present invention to enable a company providing heat stamping transfer services to have a fixed inventory of removable hot stamp transfer rollers which would enable the company to remove a used hot stamp transfer roller, immediately replace it with a new hot stamp transfer roller and then resume printing without having to incur the cost and delay of having to ship the entire core and hot stamp transfer roller back to the manufacturer to have the remaining hot stamp transfer roller ground away from the central core and replaced with a new hot stamp transfer roller. The removable hot stamp transfer roller could be replaced with a new or used hot stamp transfer roller depending upon the desires of the user.

While silicone is the preferred material for the hot stamp transfer roller, it is also within the spirit and scope of the present invention to use other elastomeric materials such as polyvinyl, natural rubber, and synthetic rubber.

The present invention is an improvement over prior art non-removable and non-replaceable hot stamp transfer rollers permanently affixed to a central core. In the prior art, when the hot stamp roller needs to be replaced, the prior art requires the entire remaining portion of the hot stamp roller and central hub to be taken to a specialized facility where the hot stamp roller is physically removed through a grinding process or other expensive process in order to physically remove the hot stamp roller so a new hot stamp roller can be physically affixed to the central core. The prior art does not have a screw-in threaded insert and instead, is one unitary piece having an interior metal section which is chemically bonded to a silicone hot stamp transfer roller. The hot stamp transfer roller assembly weighs about seven pounds. The prior art has the silicone hot stamp transfer roller affixed to the aluminum metal center roller so that when the silicone is used up during its runs, it is necessary to return the entire roller to have the silicone portion ground away by the manufacturer and replaced with a new silicone roller. This is both expensive and time consuming in that the entire roller assembly, which by way of example if it were a one-inch hot stamp transfer roller would weigh seven pounds which means that after it is used up, it is necessary to ship it back to the manufacturer to have the silicone hot stamp transfer roller ground off the central hub and the entire assembly refinished and then replaced with a substitute hot stamp transfer roller.

While it is within the scope and intention of this invention that the device be used for the application of hot stamping foil it is also within the spirit and scope that this invention can be used to replace rollers currently being used to heat seal various plastic items including but not limited to clothing storage bags and water bed mattresses. They can also be used to apply hot laminating films to various substrates as well as apply wood laminates for the home decorating and furniture industries.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
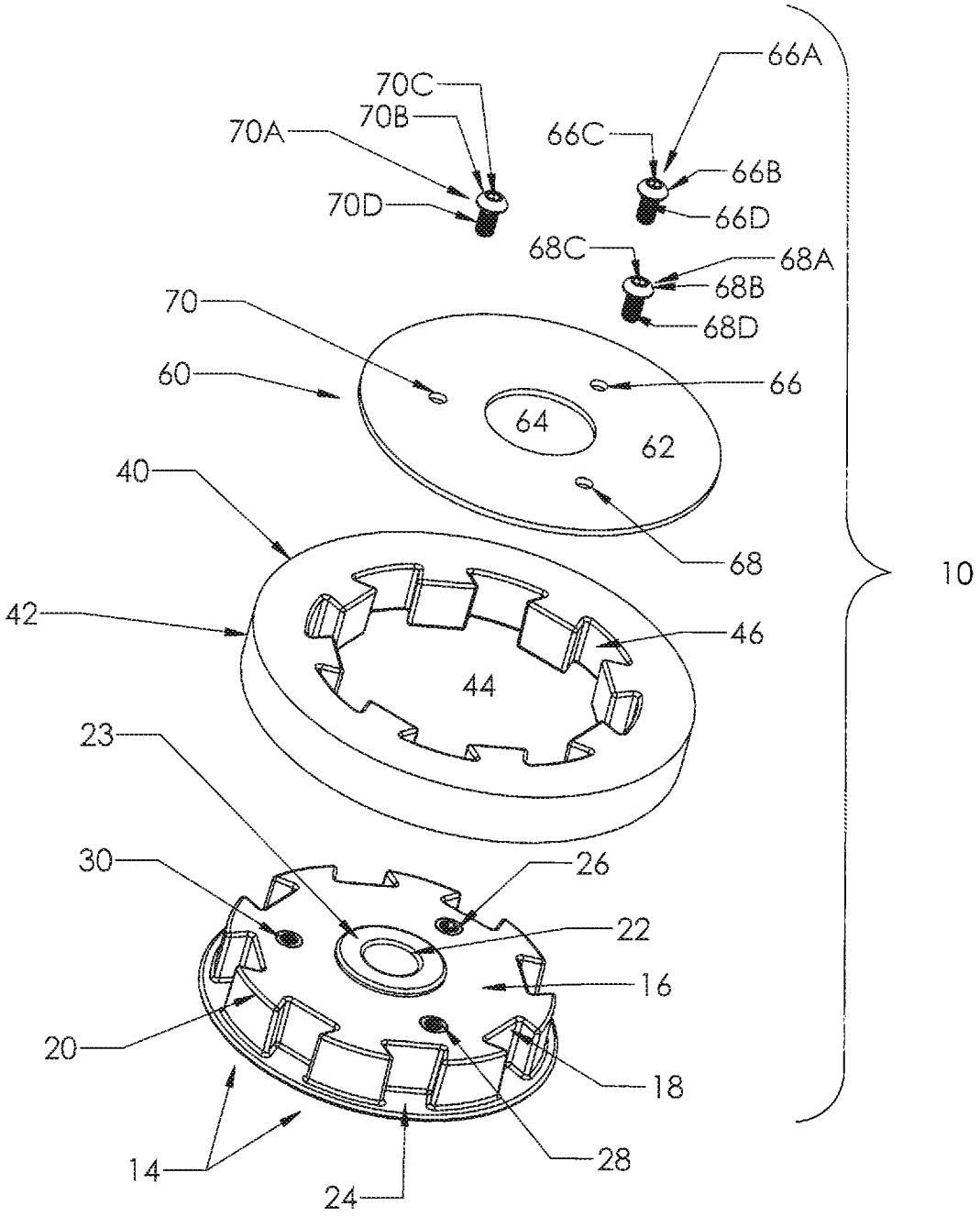
FIG. 1 is an exploded view illustrating all components of the present invention including the central hub, the removable hot stamp transfer roller, the cover plate and attachment members.

To best explain the components of the present invention, the components are set forth in an exploded view. Referring to FIG. 1, there is illustrated an exploded view of the present invention replaceable hot stamp transfer roller assembly 10. The first component is a central hub 20, with the second component being the removable hot stamp transfer roller 40, and the third component being the cover 60 to retain the removable hot stamp transfer roller 40 to the central core or central hub 20 which includes a body 18 with a central opening 22 to receive a spindle from a machine which rotates the present invention 10 during the hot stamp transfer process. The central opening 22 is surrounded by a raised central disc 23. The upper interior surface 16 of the body 18 includes at least one and preferably a multiplicity of attachment receiving members. In an embodiment illustrated in FIG. 1 and several other figures, the multiplicity of attachment receiving members includes three spaced apart threaded female openings 26, 28 and 30 which are spaced approximately 120 degrees apart and extend from the upper surface 16 into the body 18. A bottom plate 24 provides an opposite surface to the upper surface 16. The exterior circumference 14 of the central hub 20 includes a multiplicity of mating interlocking members including tongue and grove members extending around the entire exterior circumference 14 of the central hub 20, which tongue and groove members will be described in greater detail in FIG. 2.

Further referring to FIG. 1, the second component of the present invention 10 is replaceable hot stamp roller 40 having an exterior circumferential surface 42 having the hot stamp transfer foil thereon. The hot stamp transfer roller 40 has a central opening 44 surrounded by an interior circumferential surface 46 which includes a multiplicity of mating interlocking members including tongue and groove members extending around the entire interior circumference 46 of the of the replaceable hot stamp transfer roller 40, which mating tongue and groove members will be described in greater detail in FIG. 2.

Further referring to FIG. 1, there is illustrated the third component of the present invention 10 which is a cover plate 60 having a body 62 surrounding a central opening 64 which is aligned with openings 44 and 22 when the cover plate 60 is in place. The cover plate central opening 64 has a diameter sufficiently large to receive the raised central disc 23 of the central hub 20. The cover plate 60 has at least one and preferably a multiplicity of openings aligned with the at least one and preferably a multiplicity of attachment receiving members in the central hub 20. In an embodiment illustrated in FIG. 1 and several other figures, the multiplicity of attachment receiving member openings include three spaced apart openings 66, 68 and 70 which are spaced approximately 120 degrees apart and respectively aligned with openings 26, 28 and 30 in central hub 20. The attaching members, which by way of example, are three threaded bolts 66A, 68A and 70A, affix the components 20, 40 and 60 of the present invention 10 together. A respective threaded bolt 66A is aligned with opening 66 in the cover plate 60 and threaded opening 26 in the core 20. The threaded bolt 66A has a top 66B with a tool receiving portion 66C to receive an affixing tool such as a screwdriver, and a threaded shaft 66D with threads to match with the threads in opening 26. Similarly, a respective threaded bolt 68A is aligned with opening 68 in the cover plate 60 and threaded opening 28 in the core 20. The threaded bolt 68A has a top 68B with a tool receiving portion 68C to receive an affixing tool such as a screwdriver, and a threaded shaft 68D with threads to match with the threads in opening 26. Similarly, a respective threaded bolt 70A is aligned with opening 70 in the cover plate 60 and threaded opening 30 in the core 20. The threaded bolt 70A has a top 70B with a tool receiving portion 70C to receive an affixing tool such as a screwdriver, and a threaded shaft 70D with threads to match with the threads in opening 30.

Figure 2:
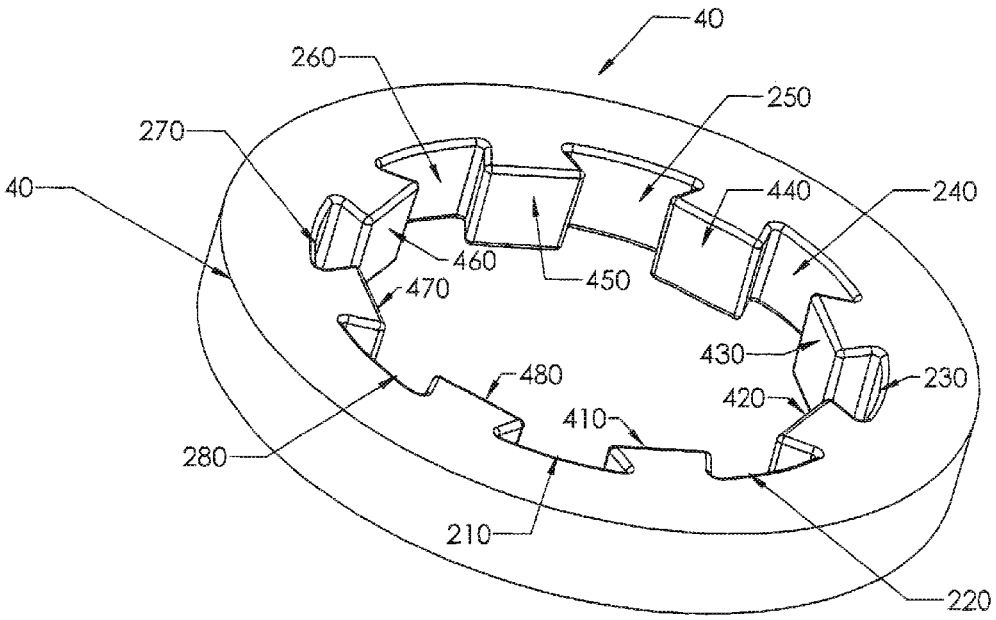
FIG. 2 is a detailed enlarged exploded view of the central hub and the removable hot stamp transfer roller, illustrating the mating tongue and groove members for each.
Figure 2:
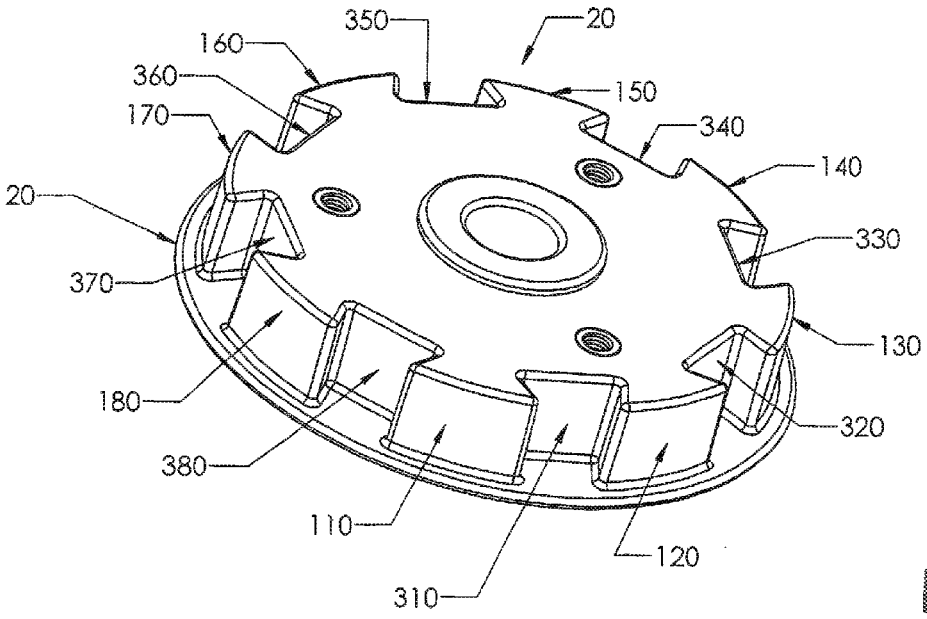

Referring to FIG. 2, there is further illustrated an exploded view of the removable hot stamp transfer roller 40 and the central core 20. The parts have interlocking tongue-and-groove assemblies which enable the hot stamp transfer roller 40 to be securely affixed to the central core or central hub 20 while at the same time being removable after the cover plate 60 is removed.

Respectively, examining the two components, the central hub has a male tongue 110 which aligns with the female groove 210 in the hot stamp transfer roller 40. The central hub 20 has a male tongue 120 which aligns with the female groove 220 in the hot stamp transfer roller 40. The central hub 20 has a male tongue 130 which aligns with female groove 230 in the hot stamp transfer roller 40. Central hub 20 has a male tongue 140 which aligns with the female groove 240 in the hot stamp transfer roller 40. The central hub 20 has a male tongue 160 which aligns with the female groove 260 in the hot stamp transfer roller 40. Central hub 20 has a male tongue 170 which aligns with female groove 270 in the hot stamp transfer roller 40. Finally, central hub 20 has a male tongue 180 which aligns with the female groove 280 in the hot stamp transfer roller 40.

For the central hub, a male tongue in the central hub has female grooves on either side of it. Similarly for therefor the hot stamp transfer roller, each female groove has a male tongue on either side of it.

Further referring to FIG. 2, respectively further examining two of the components, the central hub 20 has a female groove 310 which aligns with the male tongue 410 in the hot stamp transfer roller 40. the central hub 20 has a female groove 310 which aligns with the male tongue 410 in the hot stamp transfer roller 40. The central hub 20 has a female groove 320 which aligns with the male tongue 420 in the hot stamp transfer roller 40. The central hub 20 has a female groove 330 which aligns with the male tongue 430 in the hot stamp transfer roller 40. The central hub 20 has a female groove 340 which aligns with the male tongue 440 in the hot stamp transfer roller 40. The central hub 20 has a female groove 350 which aligns with the male tongue 450 in the hot stamp transfer roller 40. The central hub 20 has a female groove 360 which aligns with the male tongue 460 in the hot stamp transfer roller 40. The central hub 20 has a female groove 370 which aligns with the male tongue 470 in the hot stamp transfer roller 40. The central hub 20 has a female groove 380 which aligns with the male tongue 480 in the hot stamp transfer roller 40.

Figure 3:
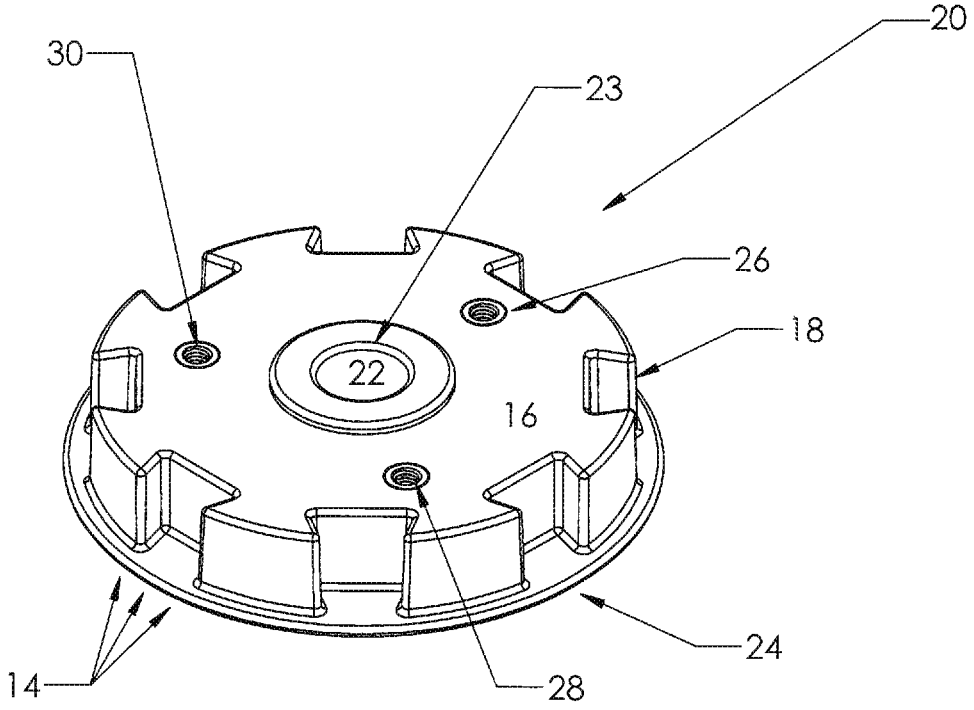
FIG. 3 is a top perspective view of the central core or central hub.
Figure 4:
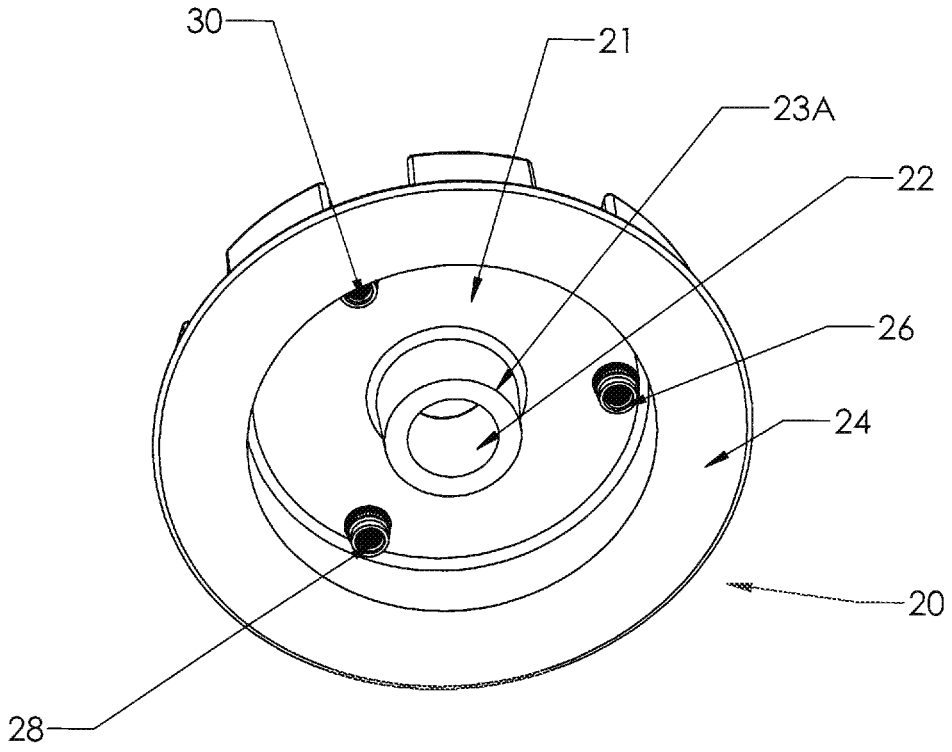
FIG. 4 is a bottom perspective view of the central core or hub.

Detailed illustrations of the central hub 20 are illustrated in FIGS. 3 through 7. Referring to FIG. 3, there is illustrated a top perspective view of the central core or central hub 20 which includes a body 18 with a central opening 22 to receive a spindle from a machine which rotates the present invention 10 during the hot stamp transfer process. The central opening 22 is surrounded by a raised central disc 23. The upper interior surface 16 of the body 18 includes at least one and preferably a multiplicity of attachment receiving members. In an embodiment illustrated in FIG. 3 and several other figures, the multiplicity of attachment receiving members includes three spaced apart threaded female openings 26, 28 and 30 which are spaced approximately 120 degrees apart and extend from the upper surface 16 into the body 18. A bottom plate 24 provides an opposite surface to the upper surface 16. The exterior circumference 14 of the central hub 20 includes a multiplicity of mating interlocking members including tongue and groove members extending around the entire exterior circumference 14 of the central hub 20, Referring to FIG. 4, there is illustrated a bottom perspective view of the central core or hub 20, with the bottom plate 24 surrounding an interior well 21, illustrating the three spaced apart threaded female openings 26, 28 and 30 which are spaced approximately 120 degrees apart and extend from the upper surface 16 into the body 18 extending into the interior well 21 forming three separate cylindrical female receiving members. The raised collar 23 also extends into the interior well to form a cylindrical spindle receiving collar 23A.

Figure 5:
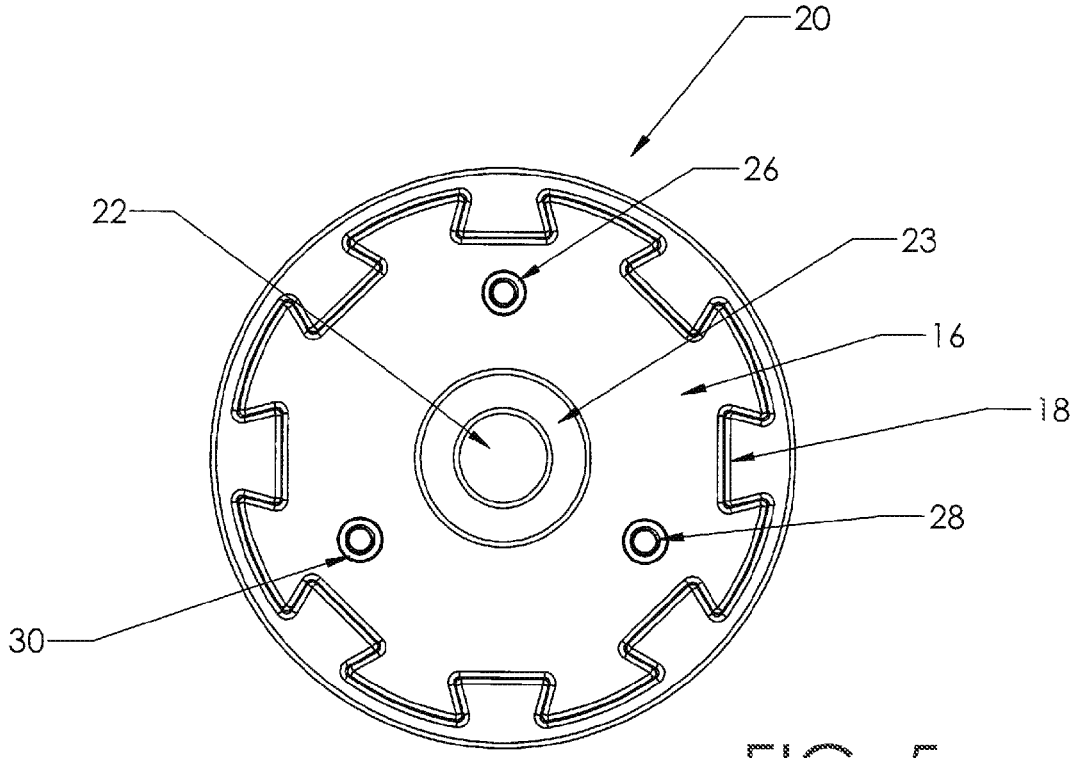
FIG. 5 is a top plan view of the central hub.
Figure 6:
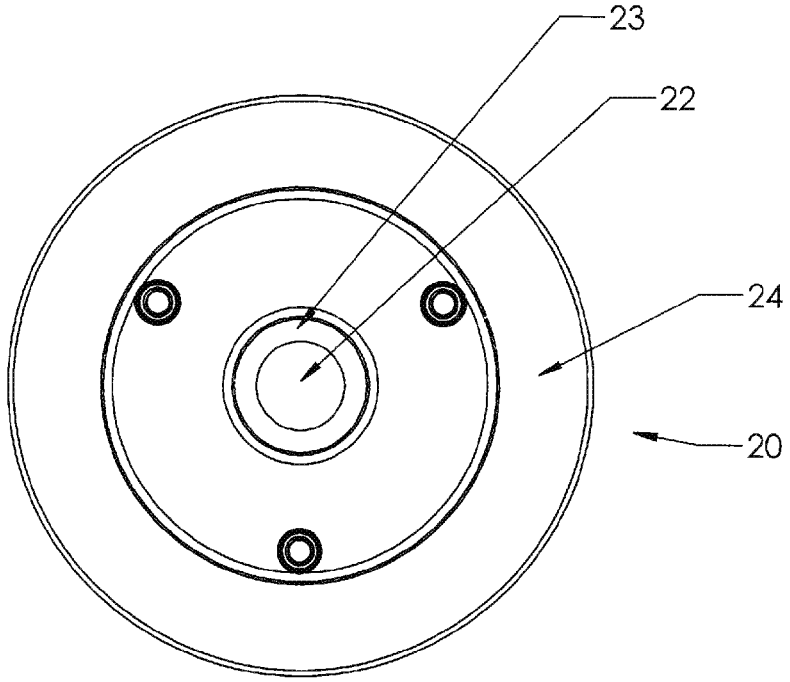
FIG. 6 is a bottom plan view of the central hub.
Figure 7:
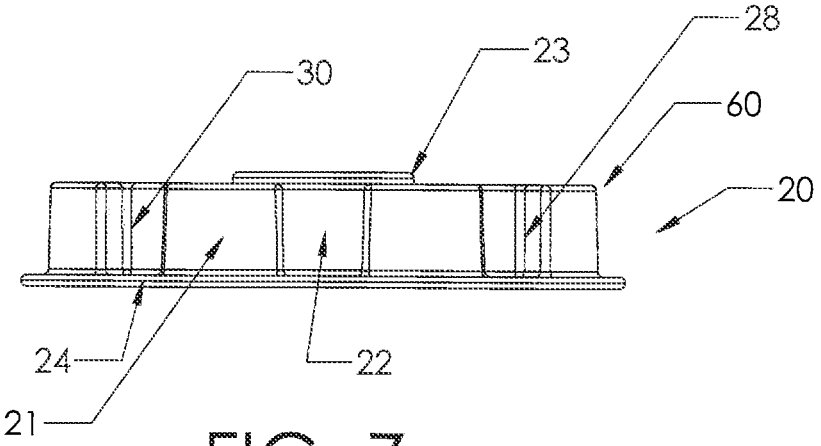
FIG. 7 is a cross-sectional of the central hub.

Further clarification, FIG. 5 is a top plan view of the central hub 20 with the parts as described in FIG. 3. FIG. 6 is a bottom plan view of the central hub 20 with the parts as described in FIG. 4. FIG. 7 is a cross-sectional of the central hub 20 with the parts as described in FIGS. 3 and 4.

Figure 8:
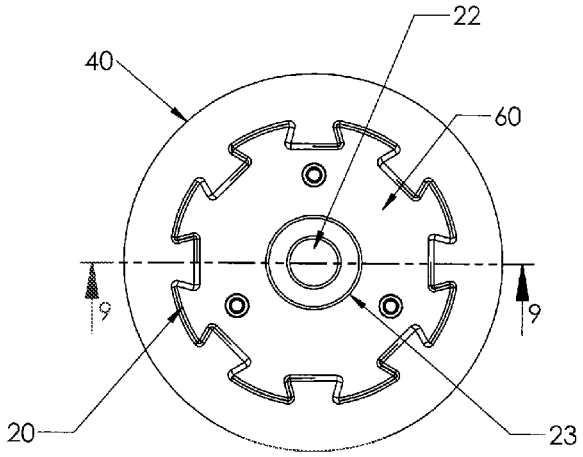
FIG. 8 is a top plan view of the present invention hot stamp transfer roller assembly with the cover plate removed to illustrate the interlocking tongue and groove assemblies of the central hub and hot stamp transfer roller.
Figure 9:
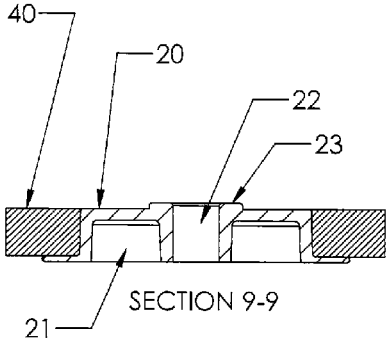
FIG. 9 is a cross-sectional view taken along line 9-9 of FIG. 8 illustrating the central core or central hub 20 with the interior well, also illustrating the raised collar extending into the interior well to form a cylindrical spindle receiving collar, and a sectional view of the removable hot stamp transfer roller 40 is also illustrated.

Referring to FIG. 8, there is illustrated a top plan view of the present invention hot stamp transfer roller assembly 10, with the cover plate 60 removed to illustrate the interlocking tongue and groove assemblies of the central hub 20 and hot stamp transfer roller 40. FIG. 9 is a cross-sectional view taken along line 9-9 of FIG. 8 illustrating the central core or central hub 20 with the interior well 21, also illustrating the raised collar 23 extending into the interior well 21 to form a cylindrical spindle receiving collar 23A. A sectional view of the removable hot stamp transfer roller 40 is also illustrated.

Figure 10:
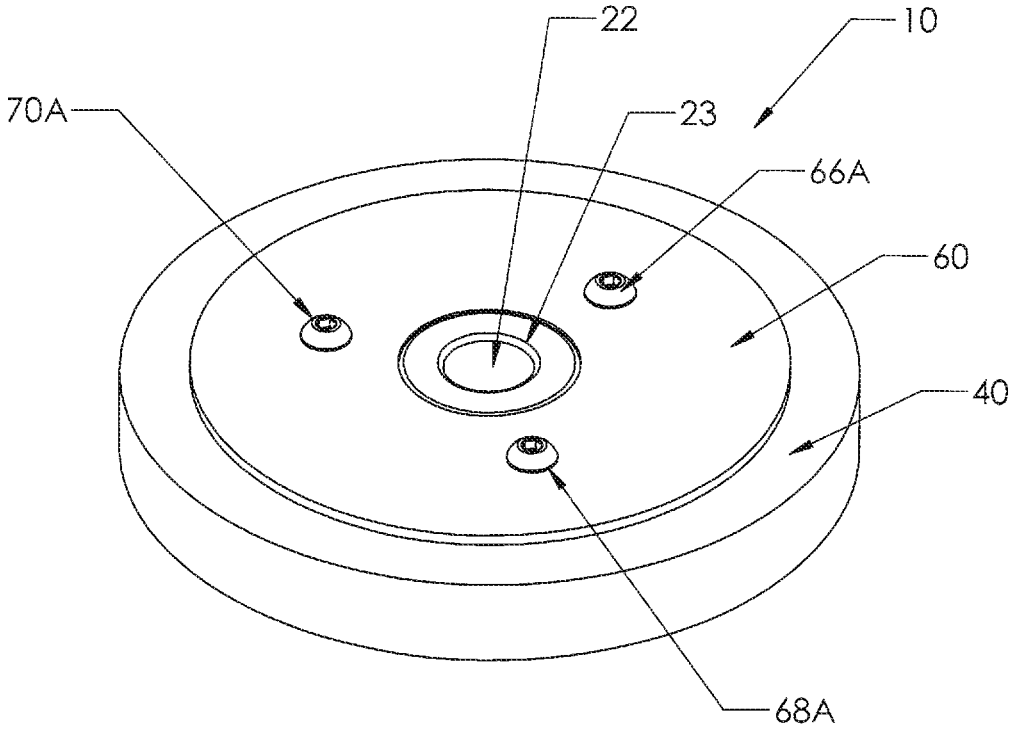
FIG. 10 is a top perspective view of the fully assembled replaceable hot stamp example of an affixation means as other affixation means are within the spirit and scope of the present invention.

Referring to FIG. 10, there is illustrated a top perspective view of the fully assembled replaceable hot stamp transfer roller assembly 10 including a central core or hub surrounded by the hot stamp transfer roller 40 with the cover plate 60 affixed over the tongue and groove interlocking members of the central hub 20 and hot stamp transfer roller 40 by threaded bolts 66A, 68A and 70A respectively received in threaded openings in the central hub. By covering the interlocking members such as the interlocking tongue and groove assemblies of the central hub 20 and hot stamp transfer roller 40, the assembly 10 is sandwiched between cover plate 60 and bottom plate 24 of the central hub 20 to assure the interlocking tongue and groove assembly will remain in place even when the assembly 10 is subjected to vigorous activity during a hot stamping process. As additional security, the raised central disc 23 of the central hub 20 is received in central opening 62 of cover plate 60 so that the top surface 25 of raised central disc 24 is aligned with the top surface 64 of cover plate 60.

While silicone is the preferred embodiment for the hot stamp transfer roller 40, it is within the spirit and scope of the present invention to include other elastomeric materials such as elastomeric polymers such as poly vinyl, polyethylene rubber, both synthetic and genuine rubber, and other comparable materials which can be used as a hot stamp transfer roller. With respect to the central hub, the preferred embodiment is made of aluminum. It is within the spirit and scope of the present invention for the embodiment to be made of stainless steel or any other suitable metal.

The central core 20 can be made of metal or non-metallic material. For metal, the metal is selected from the group consisting of aluminum which is the preferred material, steel, stainless steel, brass, copper, molybdenum, chromium, magnesium and bronze.

For the central core or central hub, other non-metallic materials are also within the spirit and scope of the present invention. Such non-metallic materials are selected from the group consisting of glass filled nylon. polyvinyl chloride, polyethylene, polypropylene, polycarbonate and thermoplastic polymers.

For the removable hot stamp transfer roller, the preferred material is silicone. However, other materials are also within the spirit and scope of the present invention and are selected from the group consisting of polyurethane, polyethylene, both synthetic and genuine rubber, an other elastomeric polymers.

While the primary focus of the present invention is the tongue-and-groove assembly as described above for interlocking and removably affixing the hot stamp transfer roller to the central core, other removable affixation assemblies are also within the spirit and scope of the present invention. By way of example, these additional interlocking movable members include locking side beads, mating locking side beads and mating annular grooves. The core as illustrated shows a bottom plate which is necessary in order to prevent the tongue-and-groove assembly from slipping out of each other. In an alternative embodiment, if the central core is made out of non-metallic material, then there could be a removable plate on the bottom of the core and another removable plate on the top of the hot stamp transfer roller which would then sandwich the two together and be retained by mating bolts extending through the plate and into receiving openings in the central core.

The plate can be a removable plate, it can be a flange which is non-removable, a circumferential locking device to retain the affixation members between the core and the hot stamp transfer roller.

Among the advantages of the present invention design: (1) The interlocking fit of the tongue and groove design between the outer silicone rubber roller and hub provide the critical mechanical connection to withstand the rotational stress that is applied during use. (2) The retaining plate is designed to capture and position the outer silicone rubber roller to fully engage the tongue and groove design and to insure its resistance to any axial stress that is applied during use. (3) It is this totally mechanical interconnection design that allows the user to easily remove the retaining plate and replace the silicone rubber roller with a new removable silicone roller or one that has been used previously.

It is within the spirit and scope of the present invention to include other forms of retention selected from the group consisting of:

(1) Interlocking members: this form of retention will be an opening in the core and a male stud coming from the cover plate or device or the reverse, having the male stud in the core, and (2) Interlocking mechanical surfaces: this form of retention will have a post from either the hub or the plate and a key opening in the other member so that you can rotate one relative to the other to have the interlocking with the key.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A hot stamp transfer roller assembly comprising:

a. a central hub including a body with an upper surface having a central opening and including a multiplicity of attachment receiving members at spaced apart locations on and extending from the upper surface into the central hub, a bottom plate, an exterior circumference including a multiplicity of mating interlocking members extending around at least a portion of an exterior circumference of the central hub and affixed to the bottom plate;

b. a replaceable hot stamp transfer roller having an exterior circumferential surface retaining hot stamp transfer foil thereon, the hot stamp transfer roller including a central opening surrounded by an interior circumferential surface which includes a multiplicity of mating interlocking members extending around at least a portion of the interior circumferential surface;

c. a cover plate having a body with a central opening aligned with the central openings in the hot stamp transfer roller and the central hub, the cover plate including a multiplicity of openings aligned with the multiplicity of attachment receiving members in the central hub, a multiplicity of attachment members, with a respective one of the multiplicity of attachment members extending through a respective one of the multiplicity of openings in the cover plate and extending into and affixed into a respective one of the multiplicity of attachment receiving members in the central hub aligned with the respective one opening the cover plate;

d. the multiplicity of mating interlocking members of the removable hot stamp transfer roller removably interlocked with the multiplicity of mating interlocking members of the central hub; and e. the cover plate removably affixed to the central hub to sandwich the removable hot stamp transfer roller between the cover plate and the plate of the central hub, the cover plate covering the mating interlocking members of the hot stamp roller and the central hub.

2. The hot stamp transfer roller assembly in accordance with claim 1, further comprising:

a. the central hub including a raised central disc surrounding the central opening and extending above the upper surface of the central hub; and b. the raised disc in the central hub extending into the central opening in the cover plate.

3. The hot stamp transfer roller assembly in accordance with claim 1, further comprising:

a. the body of the central hub extending to an interior well surrounded by the cover plate, each attachment receiving member extending from the upper surface of the central hub into the interior well;

b. the raised central disc extends into the interior well and forms a cylindrical spindle receiving collar.

4. The hot stamp transfer roller assembly in accordance with claim 1, further comprising:

a. the interlocking members of the central hub are tongue and groove;

b. the mating interlocking members of the removable hot stamp transfer roller are tongue and groove; and c. the interlocking members and mating interlocking members are a respective tongue of the central hub interlocking members extends into and is retained in a respective groove of the removable hot stamp transfer roller and a respective groove of the central hub interlocking members has a respective tongue of the central hub extending into and retained in a respective groove of the removable hot stamp transfer roller.

5. The hot stamp transfer roller assembly in accordance with claim 4, further comprising:

a. the interlocking tongue and groove members of the central hub extend around an entire exterior circumference of the central hub; and;

b. the mating interlocking tongue and groove members of the removable hot stamp transfer roller extend around an exterior circumference of the hot stamp transfer roller.

6. The hot stamp transfer roller assembly in accordance with claim 1, further comprising:

a. the interlocking members of the central hub extend around an entire exterior circumference of the central hub; and b. the mating interlocking members of the removable hot stamp transfer roller extend around an entire interior circumference of the removable hot stamp transfer roller.

7. The hot stamp transfer roller assembly in accordance with claim 1, further comprising:

a. the multiplicity of attachment receiving members of the central hub are three spaced apart threaded female openings which are spaced approximately 120 degrees apart; and b. the multiplicity of attachment members are three threaded bolts, each threaded bolt respectively aligned a respective opening in the cover plate and threaded into a respective threaded female opening in the central hub.

8. The hot stamp transfer roller assembly in accordance with claim 1, further comprising: the hot stamp transfer roller is made of material selected from a group consisting of silicone, elastomeric materials, polyvinyl, natural rubber, and synthetic rubber.

9. The hot stamp transfer roller assembly in accordance with claim 1, further comprising:

the central hub is made of material selected from a group consisting of aluminum, steel, stainless steel, brass, copper, molybdenum, chromium, magnesium, bronze, injection molded glass filled nylon, PVC, Urethane and other plastics.

10. An apparatus comprising:

a. a central hub having a bottom fixed plate and an extending cylindrical section affixed to the bottom fixed plate, the extending cylindrical section including a multiplicity of spaced apart tongue and groove members extending around an exterior circumference of the cylindrical section with a respective groove adjacent opposite sides of each respective tongue and a center area including a multiplicity of threaded mating members, and a central opening;

b. a removable hot stamp transfer roller containing a multiplicity of tongue-and-groove members on an interior circumferential surface, a respective tongue of the central hub aligns with a respective groove of the hot stamp transfer roller and a groove in the central hub aligns with a respective interior facing tongue of the hot stamp transfer roller to removably engage and retain the central hub and hot stamp transfer roller together; and c. a cover plate having a multiplicity of openings, a respective threaded bolt inserted through a respective opening in the cover plate and threaded into a respective aligned threaded opening in the central hub so that the cover plate serves to retain the hot stamp transfer roller to the center hub, the hot stamp transfer roller removably affixed to the central hub to facilitate replacement of a used hot stamp transfer roller by removing the cover plate, disengaging the tongue-and-groove members of the central hub and the hot stamp transfer roller and replacing the used hot stamp transfer roller with a new hot stamp transfer roller having mating tongue-and-groove members which mate with respective tongue-and-groove members of the central hub.

11. The apparatus in accordance with claim 10, further comprising:

the hot stamp transfer roller is made of material selected from a group consisting of silicone, elastomeric materials, polyvinyl, natural rubber, and synthetic rubber.

12. The apparatus in accordance with claim 10, further comprising:

the central hub is made of material selected from a group consisting of aluminum, steel, stainless steel, polished steel, brass, copper, molybdenum, chromium, magnesium and bronze.

* * * * *